US005168730A

United States Patent [19]

Conti

[11] Patent Number: 5,168,730

[45] Date of Patent: Dec. 8, 1992

[54] INDUSTRIAL KNITTING MACHINE, FOR WORKING IN RECIPROCATING MOTION AND CONTINUOUS MOTION AND INCLUDING PATTERN WORK

[75] Inventor: Paolo Conti, Florence, Italy

[73] Assignee: Conti Florentia S.r.l., Florence, Italy

[21] Appl. No.: 691,131

[22] Filed: Apr. 25, 1991

[30] Foreign Application Priority Data

Apr. 27, 1990 [IT] Italy ..... 9376 A/90

[51] Int. Cl.[5] ..... D04B 9/26; D04B 9/46

[52] U.S. Cl. ..... 66/222; 66/25; 66/215

[58] Field of Search ..... 66/25, 26, 215, 216, 66/222

[56] References Cited

U.S. PATENT DOCUMENTS

| | | | |
|---|---|---|---|
| 2,000,798 | 5/1935 | Swinglehurst, Jr. | 66/222 |
| 2,754,669 | 7/1956 | Lombardi | 66/222 |
| 3,922,886 | 12/1975 | Moyer | 66/222 |
| 4,709,563 | 12/1987 | Camiciotti et al. | 66/222 |
| 4,718,254 | 1/1988 | Lonati | 66/222 X |
| 4,879,884 | 11/1989 | Bertagnoli | 66/222 X |

FOREIGN PATENT DOCUMENTS

| | | | |
|---|---|---|---|
| 2919245 | 11/1979 | Fed. Rep. of Germany | 66/222 |
| 705258 | 5/1966 | Italy | 66/222 |
| 2164361 | 5/1986 | United Kingdom | 66/222 |

*Primary Examiner*—Werner H. Schroeder
*Assistant Examiner*—John J. Calvert
*Attorney, Agent, or Firm*—McGlew and Tuttle

[57] ABSTRACT

To produce pattern work and plain jersey, and comprising sets of selection levers for controlling needles which are to be lifted to a higher loop-clearing height and to a lower loop-retaining height, interacting with oscillating selectors, the machine comprises in combination: symmetrical lifting cams (20, 32); symmetrical lowering cams (441; 442; 443; 444) and corresponding counter cams (461; 462; 463; 464) defining two adjacent zones of maximum lowering; pushing cams (490) arranged between these two zones, to exclude the butts of the needles from the action of the secon zone of maximum lowering; symmetrically arranged pushing realignment cams (501A, 501B; 502A, 502B; 503A, 503B; 504A, 504B and 511A, 511B; 512A, 512B; 513A, 513B; 514A, 514B), to prepare all the butts in a row of butts of selectors for selection; partial-lowering cams (20C) to predispose for selection; and cams (701; 703) for the partial re-lifting of selectors of unlifted needles, and for their realignment with the selectors of needles previously lifted for the purpose of drawing yarn.

8 Claims, 6 Drawing Sheets

INDUSTRIAL KNITTING MACHINE, FOR WORKING IN RECIPROCATING MOTION AND CONTINUOUS MOTION AND INCLUDING PATTERN WORK

FIELD OF THE INVENTION

The invention relates to an industrial circular knitting machine with a plurality of feeders, capable of producing pattern work and plain jersey. The machine offers many functions, great simplicity of operation, great reliability and other advantages, which will become clear on reading the text which follows.

SUMMARY OF THE INVENTION

The machine comprises sets of selection levers for controlling needles which are to be lifted to a higher loop-clearing height and to a lower loop-retaining height, interacting with oscillating selectors, and additionally comprises in combination: lifting cams; lowering cams and corresponding counter cams; symmetrically arranged, pushing realignment cams, to prepare all the butts in a row of butts of selectors for selection; partial-lowering cams to predispose for selection; and cams for the partial re-lifting of the selectors of unlifted needles, and for their realignment with the selectors of needles previously lifted for the purpose of drawing yarn.

The machine advantageously works with reciprocating motion and all the cams are positioned symmetrically about the feeders and/or about the mid-point between adjacent feeders. In particular, the selection levers act in the interval between the zones of maximum lowering and between the realignment cams, in both directions of motion. Furthermore, the lowering cams and corresponding counter cams define two adjacent zones of maximum lowering, and between these two zones are pushing cams to exclude the butts of the needles from the action of the second zone of maximum lowering.

For pattern work with continuous motion, the machine comprises pressers to exclude from the lowering action needles active at certain feeders of yarns involved in the pattern; at least one of the feeders is without such a presser, so as to cause the stitch to be formed with all the yarns accumulated by the needle which arrive at this feeder.

The selection levers act in the space between the two zones of maximum lowering of the needles, on oscillating selectors for lifting to the clearing height and the retaining height respectively; a pusher interacts with said selectors as does an oscillating jack which is articulated to the needle. The oscillating selectors, pusher and needle with oscillating jack are contained in the same trick; and the pusher acts to push the oscillating jack out and to re-lower the selectors.

BRIEF DESCRIPTION OF THE DRAWINGS

The invention will be better understood by following the description and accompanying drawing, which latter shows a practical, non-limiting illustrative embodiment of said invention. In the drawing.

DETAILED DESCRIPTION OF THE PREFERRED EMBODIMENT

Figure 2:
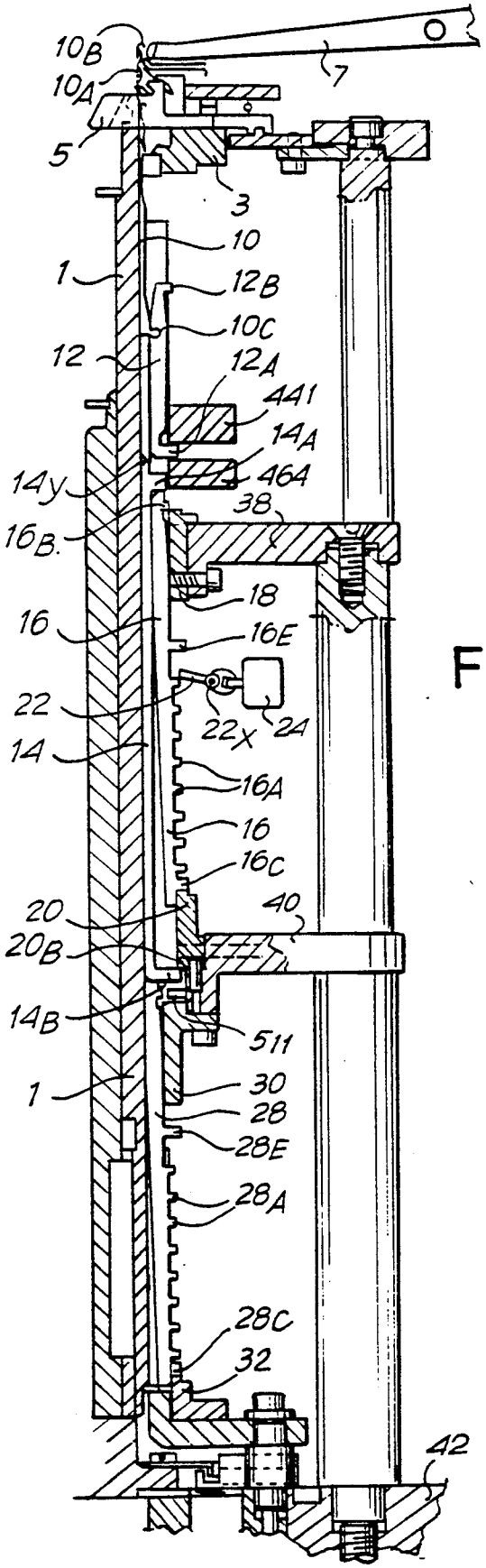
FIG. 2 shows a diagrammatic half-section of the cam-box and cylinder.
Figure 3:
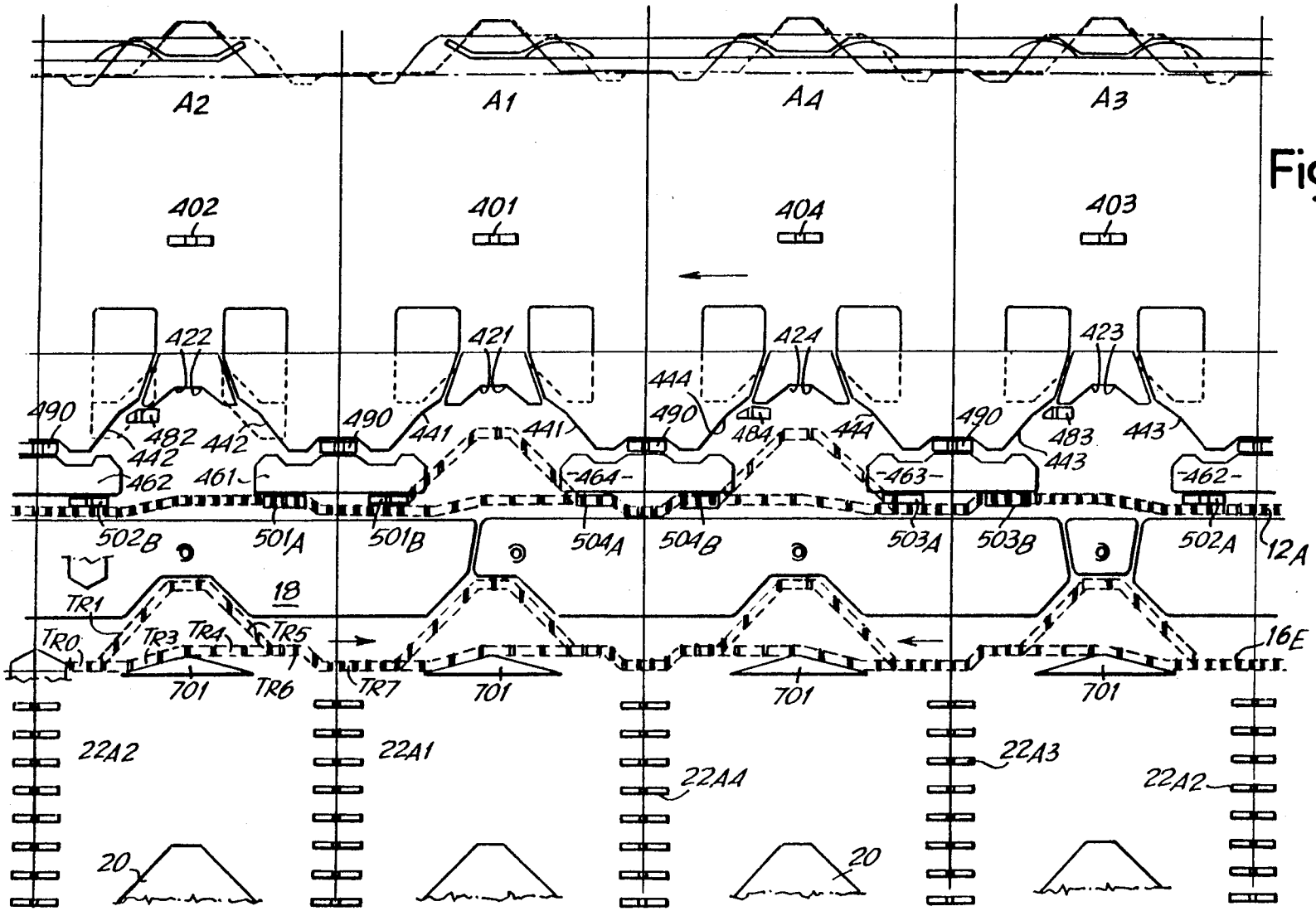
FIGS. 3 to 6 show enlarged details.
Figure 4:
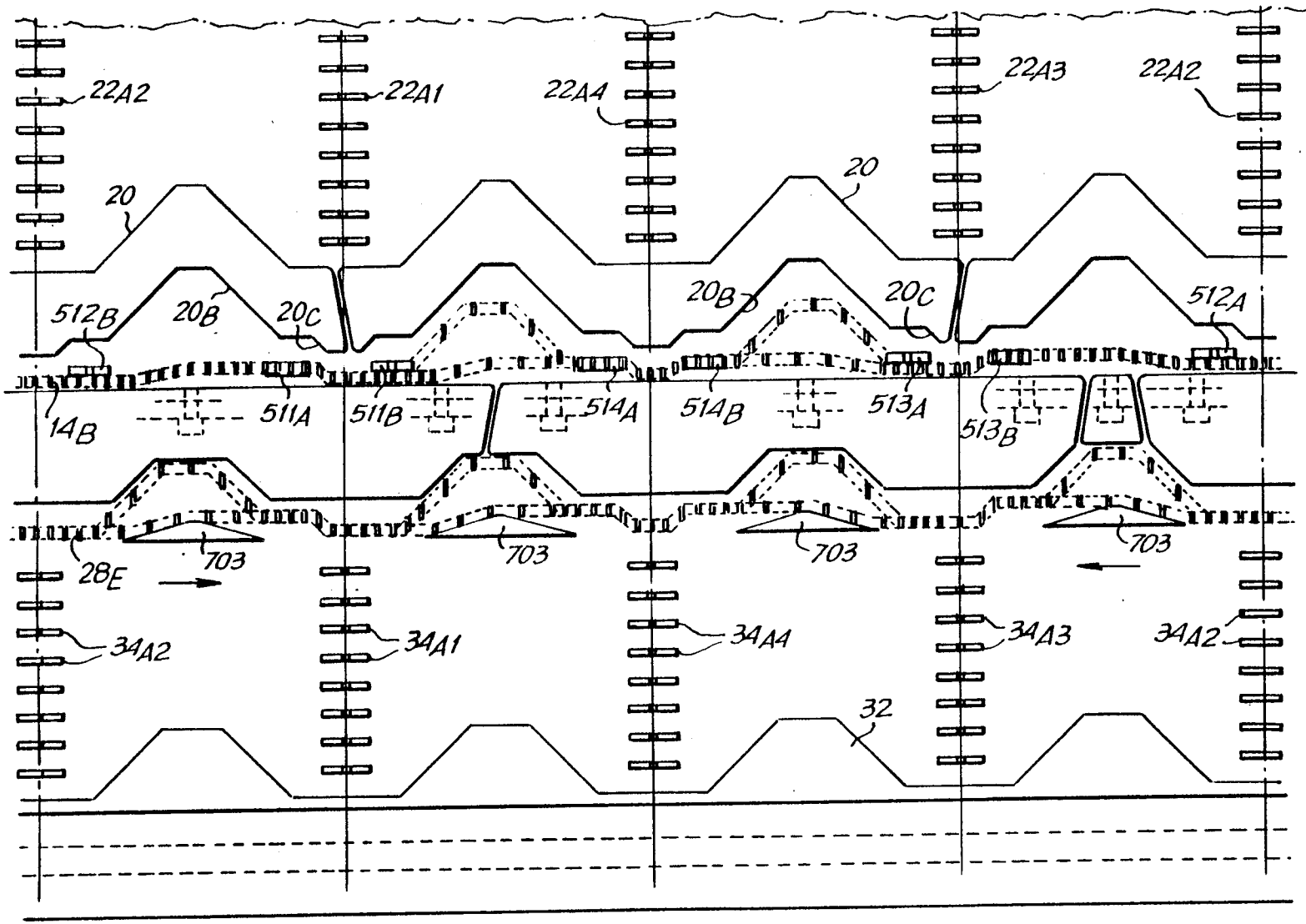
Figure 5:
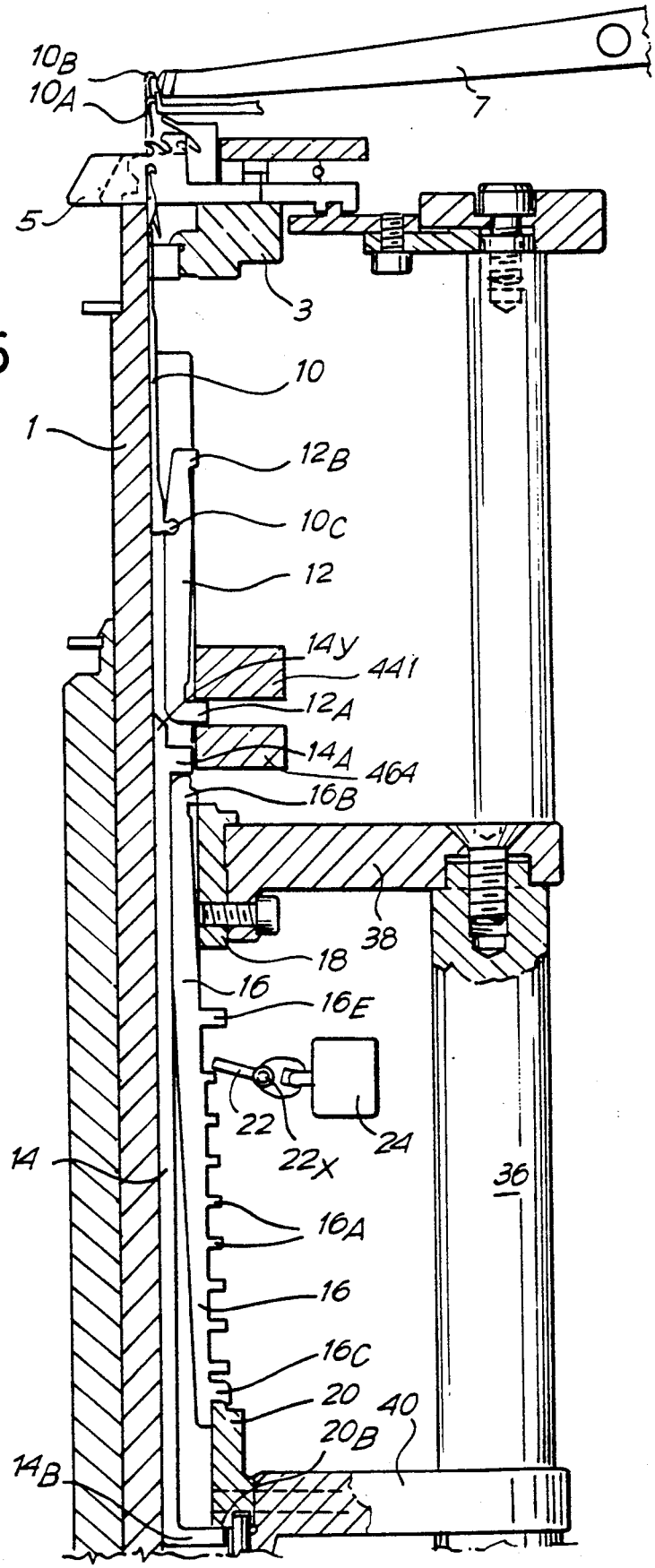
Figure 6:
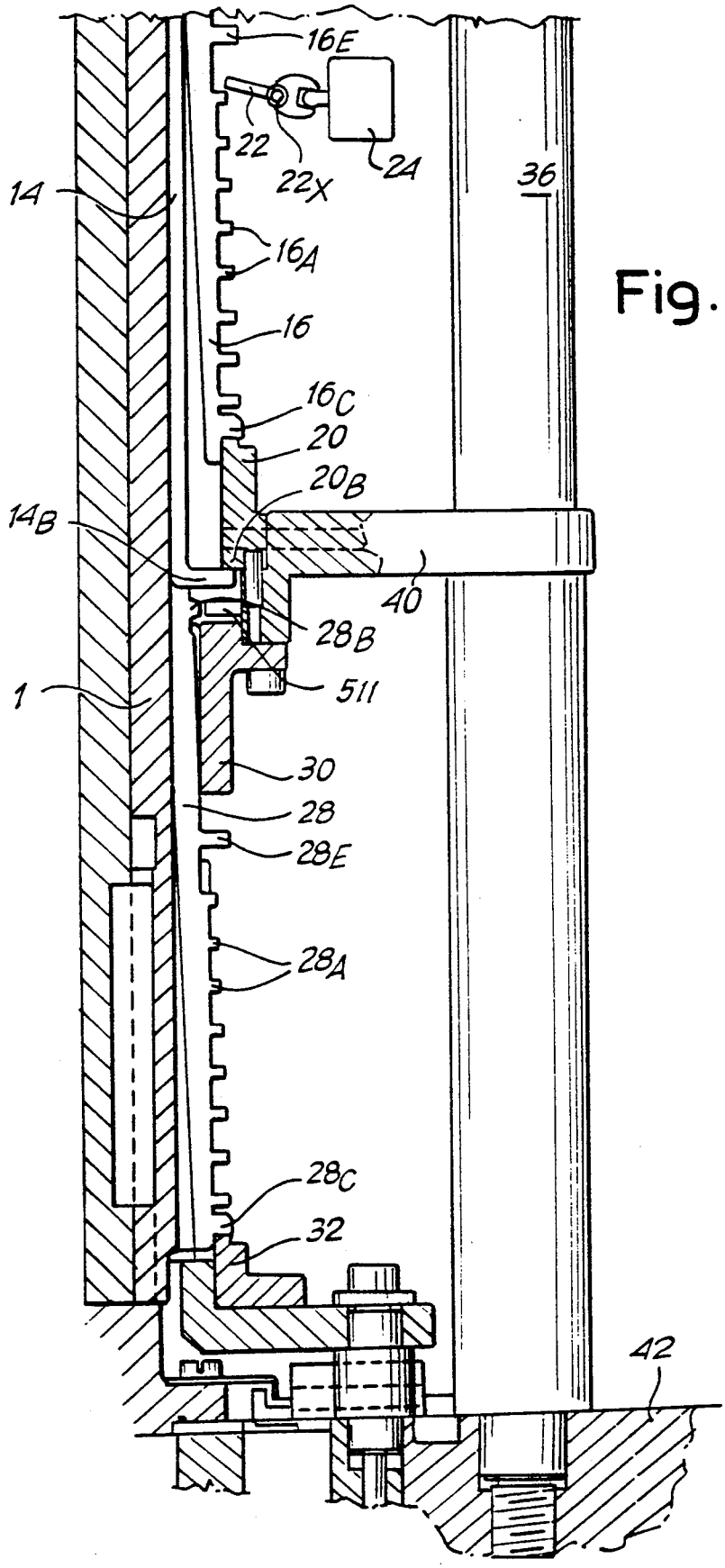

In the attached drawings, 1 indicates the needle cylinder with its conventional longitudinal slots for the needles and for the selectors or jacks interacting with said needles; 3 indicates the ring which runs round the top of the needle cylinder to guide the sinkers 5; 7 indicates the yarn guides as a whole: these can be substituted to deliver the yarn to the needles raised in the needle clearing position and in the needle retaining position i.e. with the previous loop uncleared from the latches of the needles. As shown in the drawing, the machine comprises four feeders, that is four yarn-feeding positions, indicated respectively by A1 for feeding the yarn intended to produce plain stitch and by A2, A3, A4 for feeding yarns which may be intended to form a pattern and which may be substituted by yarns for producing stocking stitch, as in the feeder A1. Contained in each of the tricks of the needle cylinder 1 is a needle 10 which can be lowered to a stitch forming height as shown in FIG. 2 and partially raised, that is to the loop-retaining height as indicated by the head 10A and to a higher loop-clearing height as indicated by the head 10B. Each needle 10 has its own lower foot 10C which engages by articulation with a pusher or jack 12 which has a bottom butt 12A and a top butt 12B to control its oscillation. Below the oscillating jack 12 is a pusher 14 with a tapering top end to act on the bottom end of the oscillating jack 12 to push the bottom butt 12A thereof out in a radial centrifugal direction; immediately below its own tapering top end, the pusher 14 has a butt 14A which is able first to push out by means of a chamfer 14Y and then to push up the oscillating jack 12 when said pusher is lifted; the pusher 14 also has a bottom butt 14B for the purposes indicated below. Also contained in each of the tricks of the needle cylinder 1 is an oscillating selector 16 lying against the outward side of the pusher 14; this oscillating selector 16 is held by a cam-box 18 in its respective trick, in such a way that it can oscillate about a point internal to said box; the oscillating selector 16 has a series of selection butts 16A (over a multiplicity of rows), a short upper pushing butt 16B for withdrawal, and a lifting butt 16C near the bottom end of said selector 16, in order to interact by its lower inclined edge with the corresponding edge of a lifting cam 20 which is further described below and runs round the needle cylinder. Interacting at each height with the selection butts 16A are corresponding pushing plates in the form of oscillating levers 22A1, 22A2, 22A3, 22A4 such as that shown at 22 in FIG. 2, pivoting at 22X and controlled by an electromagnetic or equivalent type of actuator 24. Corresponding with each of the feeders A1, A2, A3, A4 there are corresponding sets of oscillating levers indicated generally by 22A1, 22A2, 22A3 and 22A4, which are arranged in the intermediate position between two adjacent feeders, to act in both directions of rotation of the needle cylinder, in a manner which is per se conventional. The complex of the oscillating selectors 16 with the butts 16A and corresponding sets of oscillating levers 22 (22A1, 22A2, 22A3, 22A4) serves to enable the selective lifting of the needles up to the topmost position, that is the loop-clearing height indicated by 10B. Selection of the needles takes place by causing one or other of the oscillating levers 22 to act according to the desired pattern, being activated by angling the lever down to the height of the relevant arriving butt 16A, whilst exclusion takes place by angling said oscillating lever up, all of this being in a manner known per se. The lifting of an oscillating selector 16 takes place when the selector is not thrust inwards into the trick, that is towards the pusher 14, by an activated oscillating lever 22, so that said selector 16, not being thrust inwards, engages the cam 20 with its butt 16C and is lifted by said cam 20, so lifting the bottom end of the corresponding oscillating jack 12 via the butt 14A of the pusher 14 and hence lifting up the corresponding needle 10 to the loop-clearing height indicated by 10A. All those oscillating selectors 16 that have been thrust in by the oscillating levers 22, when acting upon the butts 16A to thrust the selector 16 inwards into the trick, are not lifted and hence the needles are not lifted.

A second selection arrangement which is similar to that of the selectors 16 and levers 22 is provided below the pushers 14 and their butts 14B. This second selection arrangement comprises selectors 28, which are held by a cam-box including cams such as cam 30 and 18 and that oscillate in the zone of the cam; each selector 28 has a plurality of selection butts 28A, a short pushing butt 28B similar to that 16B at the upper end and hence immediately beneath the butt 14B of the corresponding pusher 14; each oscillating selector 28 further has a lifting butt 28C similar to 16C, for interacting with a cam 32 which is further described below and serves to lift the selector 28 by the butt 28C, when this selector has not been thrust back into the trick of the needle cylinder through action on any selection butt 28A by an oscillating lever 34 similar to 22. Corresponding to the sets of oscillating levers 22A1, 22A2, 22A3, 22A4 there are sets of oscillating levers 34A1, 34A2, 34A3 and 34A4, which serve to select the oscillating selectors 28 to bring about the lifting of particular needles up to the retaining height indicated at 10A; the lifting of the needles via the oscillating selectors 28 and the levers 34 takes place by pushing on the butted bottom ends 14B of the pushers 14 and through the butts 14A of said pushers acting on the bottom end of the oscillating jacks 12 and hence of the corresponding needles 10; the lifting height is determined by the profile of the cams 32.

The cam-box which runs round the needle cylinder is supported by a structure indicated as a whole by 36 which comprises among other things a plate 38 for the cam 18 and a plate 40 for the cam 30, as well as a base 42 which indirectly supports the cam 32.

Figure 1:
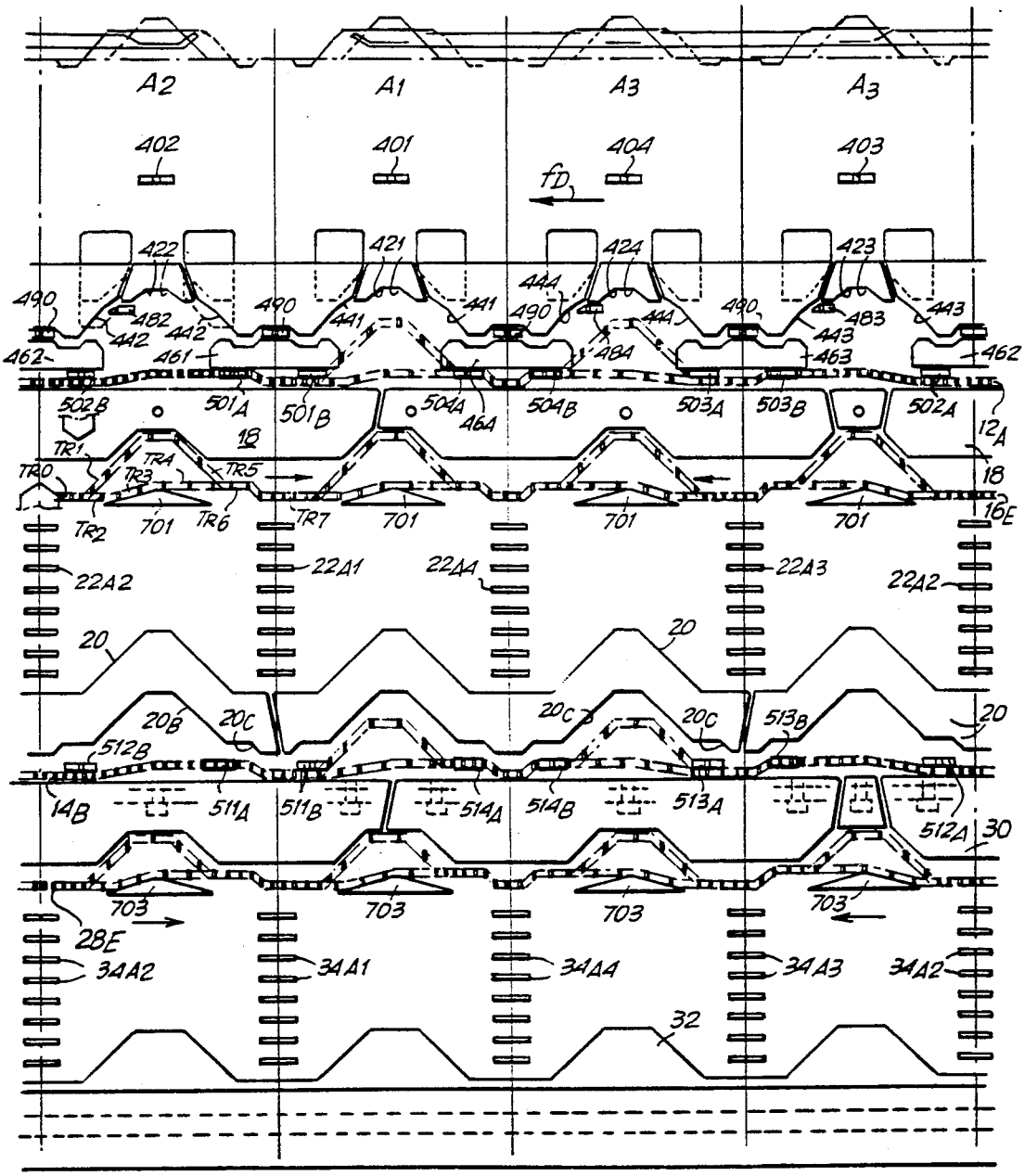
FIG. 1 shows a cam-box.

The cam-box is further illustrated in FIG. 1. Shown in this figure is a diagram of the control profiles already referred to in part in the foregoing, and which will here be further described below.

Corresponding to each of the feeders A1, A2, A3, A4 is a symmetrical radial pushing cam, 401, 402, 403, 404 respectively, which can act—at the retaining height 10A lifted by the cam 32—on the top butts 12B of the oscillating jacks 12 to thrust said butt inwards and in each case cause, the bottom butt 12A to emerge; these cams 401 . . . 404 work in particular cases. Below the radial pushing cams 401 to 404 is a symmetrical cam profile 421, 422, 423 and 424 which enables the butt 12A to be acted on for an initial lowering of the needle from the clearing height 10B down to the retaining height 10A. Still symmetrically with respect to the feeders A1, A2, A3, A4 are symmetrical lowering profiles 441, 442, 443 and 444 which can again act on the butts 12A of the oscillating jacks 12 to continue the lowering from the retaining height (to which they have been brought by the cams 421, 422, 423, 424) down to the stitch-forming height at the bottom end of the profiles 441, 442; 442, 443; 443, 444; 444, 441, formed by separate and fixed-cam bodies. The profiles 441, 442, 443, 444 basically operate like the so-called triangular cams. Between successive feeders, that is between adjacent cams 421, 422, 423, 424 and below each profile 441, 442; 442, 443; 443, 444; 444, 441 are counter cams 461, 462, 463, 464, each with a double depression opposite a double projection at the bottom of each of the triangles formed by the profiles 441, 442; 442, 443; 443, 444 respectively.

The needle cylinder can rotate in both directions to shape the heel and optionally to shape the toe. While working on the tubular parts of the article, in order to produce pattern stitches, the direction of rotation of the needle cylinder is indicated by the arrow fD from right to left when viewing the cam-box. Taking the direction of rotation fD defined above, immediately downstream of the cams 422, 423 and 424 are pressers 482, 483 and 484 which can be pushed radially in and out and are able—when pushed in for pattern work—to act on the butt 12A of the oscillating jacks 12 to thrust these jacks 12A inwards into the corresponding trick of the needle cylinder, in such a way as to prevent the action of subsequent lowering profiles 442, 443 and 444 and hence hold the needles at the retaining height 10A after the first lowering from the clearing height 10B; the stitch-forming or lowering profile 441, belonging to the feeder A1, is always active as it has no presser like those 482, 483, 484 corresponding to said feeder A1 and corresponding to the profile 441.

In the channels defined between the triangle profiles 441, 442 and the counter cam 461, between the profiles 442, 443 and the counter cam 462, between the profiles 443, 444 and the counter cam 463 and between the profiles 444, 441 and the counter cam 464 are centrally arranged symmetrical prodder plates 490, each of which thrusts out of the channel the butt 12A of the oscillating jack 12 of each needle that has been lowered by the corresponding profile 441, 442, 443 or 444; in this way, after being lowered to the maximum extent between cam and counter cam and lifted slightly back up again in the central zone of the respective counter cam (461, 462, 463, 464), the butts 12A are not obliged to repeat a further lowering (by the triangles 441, 442, 443, 444) which is not needed by the jersey and is damaging since it disturbs the needle unnecessarily and hence the loop yarn that has already formed a loop during the first maximum lowering; use of the prodders 490 thus avoids an immediate and unnecessary repetition of this maximum lowering; and this operation takes place in both directions of rotation of the needle cylinder, after maximum lowering of the needles.

Below the counter cams 461, 462, 463, 464 and symmetrically positioned with respect to them are pairs of pressers 501A, 501B; 502A, 502B; 503A, 503B; 504A, 504B which are symmetrical with respect to the counter cams 461, 462, 463, 464. These pairs of pressers 501A, 501B; 502A, 502B; 503A, 503B; 504A, 504B are designed to act on the pushing butts 16B of all the oscillating selectors 16, which in the manner indicated below are made to come together to the same height as said prodders before arriving at the selectors 22A1, 22A2, 22A3, 22A4 (in either direction of motion of the needle cylinder); the action of said prodders on the butts 16B serves to push said butts 16B inwards and hence displace the bottom part of each of the oscillating selectors 16 outwards, that is centrifugally, in order to predispose said selectors for the selection which will be made on the butts 16A by the oscillating levers 22A1, 22A2, 22A3, 22A4 respectively for selection of needles to be lifted to clearing height.

As already said, below the cam 18 are the sets of oscillating levers 22A1, 22A2, 22A3, 22A4 which are symmetrical with the counter cams 461, 462, 463, 464; said oscillating levers are symmetrical in profile so as to act in both directions of the rotation of the jacks 16 and hence of the sliding of the butts 16A, so as to carry out needle selection before the needles arrive at the feeder lying immediately after these sets of oscillating levers in the corresponding direction of rotation of the needle cylinder. In other words, the oscillating levers 22A1, for example, are able to predispose selection of the oscillating selectors so as to lift to clearing height 10B the needles 10 which reach the feeder A2 in the direction of rotation of the arrow fD and the feeder A1 in the opposite direction of rotation to the arrow fD.

Below the sets of oscillating levers 22A1, 22A2, 22A3, 22A4 is a box of repeated profiles which form the cams 20 which lift the oscillating selectors 16 with their pointed profile pointing upwards and corresponding exactly to the feeders A1, A2, A3, A4 so as to lift the oscillating selectors 16 (acting on the butts 16C) and hence the needles 10 via the oscillating jacks 12 and respective pushers 14; below this, the box which forms the lifting cams 20 forms concave pointed profiles 20B likewise corresponding to the feeders A1, A2, A3, A4, to act on the butts 14B of the pushers 14 and systematically push them back down again each time after passing the corresponding feeder (in either of the two directions of rotation of the needle cylinder).

To clarify the function of the pressers 501A, 501B; 502A, 502B; 503A, 503B; 504A, 504B (which are arranged above and symmetrically about the oscillating levers 22A1, 22A2, 22A3, 22A4), consider the direction of motion fI opposite to the direction fD of the drawings and the behavior of members positioned between the sets of oscillating levers 22A1 and 22A2 (other members function in the same way, symmetrically in the case of opposing motion in the direction fD). Attention may be drawn here to the fact that the oscillating selectors 16 all have a butt 16E, whose paths TR are shown on the left when viewing FIG. 1. When the oscillating selectors 16 reach the oscillating levers 22A2, they (and hence the butts 16A) are all at the same height (path TR0). As a result of selection by the oscillating levers 22A2, some of the oscillating selectors 16, with their butts 16C held out (path TR1), rise up the relevant ramp 20, taking the needles to clearing height 10B; the rest of the oscillating selectors, with their butts 16C pushed back inside the cylinder tricks, continue at the lower level (path TR2) until they come to a cam 701 which is symmetrical with respect to the feeder A2; such a cam is present at each feeder. The cam 701 lifts the oscillating selectors 16 slightly (path TR3) up to the path TR4, where the butts 16B line up level with the pressers 501A. The oscillating selectors 16, having been lifted by the cam 20, are lowered again by the butts 14A of the pushers 14, which last are being lowered by the descending ramp 20B, which is acting on the butts 14B of said pushers; the butts 16E of the raised oscillating selectors 16 are thus made to follow the down path TR5. The two paths TR4 and TR5 thus reunite at the height TR6, so that the butts 16B of all oscillating selectors 16 can be acted on by the presser 501A which pushes all the butts 16A out to allow subsequent selection by the subsequent oscillating levers 22A1. After the path TR4 (to which the butts 16E from the path TR5 are added) comes a path with a slight lowering TR6, which is produced by the action of the bottom end 20C of the lowering ramp 20B working on the butts 14B, down to the level of path TR7 (which corresponds to TR0) where selection takes place by the oscillating levers 22A1. The lowering from TR6 to TR7 by the profile 20C is necessary to avoid the action of the presser 501B following that 501A in the direction of motion fI. The operation is repeated with reference to the oscillating levers 22A1 and so on.

Shown on the right of FIG. 1 are the paths of the butts in the direction of motion fD, operating on the same principle.

Below the box 20, 20B and in line with the descending ramps 20B, that is in line with each of the counter cams 461, 462, 463, 464 and at the sides of the bottom profiles 20C, are pairs of prodders 511A, 511B; 512A, 512B; 513A, 513B; 514A, 514B, for acting in a radial centripetal direction on the top short pushing butts 28B of the oscillating selectors 28, to displace outwardly the bottom parts of said oscillating selectors and hence bring into action those selection butts 28A which are to be selected by the oscillating levers 34 and to selectively lift said selectors 28 and hence the needles in the course of lifting up to the retaining height 10A of the needles by means of the cam profiles 32. The cam profiles 32 correspond to individual feeders A1, A2, A3, A4, so as to lift the selectors and hence the needles in line with these feeders; the selection is by means of the oscillating levers 34 which are positioned upstream of each feeder, in whichever direction of rotation of the needle cylinder is being considered. The operation and purpose of the pressers 511A to 514B and butts 28B are similar to those of the pressers 501A to 504B and butts 16B. Cams 703 similar to those 701 interact with butts 28E similar to those 14E to control the paths of the butts 28B with respect to the pressers 511A to 514B, relative to the oscillating selectors 28, in the same way as described above in the case of the oscillating selector 16. The function described above of the butts 14B and final profiles 20C is valid both for the oscillating selectors 16 and for those 28, because the pushers 14 work on the selectors 16 through the butts 16A and on the selectors 28 through the butts 14B.

It will be seen that the needles 10, with their respective oscillating jacks 12, are lifted by the oscillating selectors 16 or 28, and are independently lowered by the stitch-forming cams 441 to 444.

In the upper zone of the needle cylinder, the profiles of the cams such as 401, 402, 403, 404; 421, 422, 423, 424; 490; 501A, 501B; 502A 502B; 503A, 503B; 504A, 504B are fixed. Cams 441, 442, 443, 444, 461, 462, 463, 464, 482, 483 and 484 are mobile. The pressers 482, 483 and 484, which have to be active in order to avoid the needles being lowered along the profiles 442, 443 and 444 in the direction of rotation fD, are mobile in order to make the pattern. The feeder A1 supplies a yarn for the formation of the stitch by means of the profile 441 and the feeders A2, A3 and A4 supply yarn for the formation of the patterns, and these yarns from the feeders A2, A3 and A4 also form stitches by means of the lowering profile 441. In the feeders A2, A3, A4, when a plain, that is non-pattern, stitch is to be formed, the pressers 482, 483, 484 are removed and the yarn guide is changed to replace the pattern yarn with the main yarn like that at A1, and all four feeders form the stitch from their own supply of yarn and with their respective lowering profiles 441, 442, 443 and 444. When a pattern is to be made, the pressers 482, 483 and 484 are controlled to push the butts 12A that have drawn the yarn during rotation in the direction of the arrow fD in order to keep the needles at the retaining height 10A after the initial lowering produced by the cam profiles 422, 423 and 424, so that they avoid being lowered to the stitch-forming height (which would be caused by the profiles 442, 443 and 444) and instead pass on at the retaining height until they come to the feeder A1. In practice, the stitch is only made at the feeder A1, that is with the profile 441 active in the direction of the arrow fD to give lowering down as far as the counter cam 461, whereas yarn fed in at A2, A3, A4 are retained by needles that are not lowered and are then joined to the yarn from feeder A1 to form a stitch: hence they form the desired pattern by means of selections carried out by the selection obtained by the oscillating levers 22, operating to carry the needles to the clearing height 10B. To cause a stitch to be made by all the needles that have drawn color yarn A2, A3 and A4, the cam 32 lifts the butts 28C causing the butt 12A to move out, while the cam 20 lifts those needles that have been selected by the oscillating selectors 22A4.

To summarize, then, to create the pattern, the selectors 16 are selectively lifted by the cam profiles 20, so lifting the butt 14A of the pusher 14, which in turn pushes out the oscillating jack 12, simultaneously lifting it and with it the corresponding needle 10 to the clearing height 10B. The needle is partially lowered through action on the butt 12A by the cams 422, 423 and 424 down to the retaining height; the corresponding presser 482, 483 and 484 being active, the butt 12A is pushed back in by this presser and the needle cannot be further lowered by the cams 442, 443 and 444 (which characteristically are fixed) and instead pass on at the retaining height. The pusher 14 is lowered once more by the profile 20B acting on its butt 14B; the oscillating selector 16 therefore also comes down through the action of the butt 14A on the top end of said oscillating selector 16; and the oscillating selector 28 is also lowered through the action of the butt 14B of the pusher 14 on the top end of said selector 28. Those needles which arrive at the feeder A1 after being partially lowered to retaining height and denied further lowering by the action of the presser 482 or 483 or 484, are again lifted (as a result of the action of the cam 32 on the oscillating selectors 28 and hence on the pushers 14), thus once again pushing out the butt 12A of the oscillating jack of the aforesaid needles, and are then lowered after passing the feeder A1. Those needles which arrive at the feeder A1 not at the retaining height but rather at the lowered height, are lifted by the cam 20 to the clearing height through the action of the activated oscillating selectors 16 and hence of the oscillating jacks 12. In short, all needles arrive at A1 either at retaining height, that is at height 10A, or at clearing height to draw the yarn from the feeder A1; and all needles form the stitch by being lowered by the fixed cam 441 into the channel created by the counter cam 461. This creates the jersey in the pattern area. To complete the jersey, in the feeder zone A1 is a further yarn guide 602—lower than the yarn guide feeding needles raised to height 10B—for a fine yarn FL which is drawn equally by needles at clearing height 10B and by needles lifted only as far as retaining height 10A (which have drawn yarn at feeders A2, A3, A4); in this way this yarn FL is formed into stitches by all the needles.

The pattern is therefore created by all four feeders and by virtue of the presence of the retractable jacks 12. With this system it is possible to make both simple patterns and so-called Fair Isle-type patterns.

To create areas of plain jersey—even with reciprocating motion—the pressers 482, 483 and 484 are withdrawn, and at the feeders A2, A3, A4 pattern-forming yarns are replaced with yarns for forming the plain jersey background so that the feeders are all the same. Stitches are formed at each feeder on all the needles with the corresponding triangle cams 442, 443, 444 which remain fixed like that 441. This too is made possible by the presence of needles with retractable jacks 12, thereby avoiding the use of moveable triangle cams to lower the stitch-forming needles, which—as is well known—cause serious problems of irregularity. It will be seen that the pressers 490—positioned in the channel defined between each of the lowering triangles 441, 442, 443, 444—ensure that after the first lowering which forms the stitch (441) and corresponding first lifting (461) the needle's maximum lowering is not repeated; this saves disturbing the needle and its loop yarn, as already indicated.

This, arrangement offers particular advantages of simplicity of control, simplification in the controls themselves and in limiting the movements of the cams, with real advantages for the regularity of the resulting jersey, for the protection of the yarn forming the jersey and for the levels of output achieved even during pattern-forming. These and other objects and advantages will be clear especially to those skilled in the art from reading the text.

It will be understood that the drawing shows only an illustrative embodiment which is given purely as a practical demonstration of the invention, it being possible for said invention to vary as regards shapes and arrangements without thereby departing from the scope of the concept underlying said invention. Any reference numbers appearing in the accompanying claims are intended to facilitate the reading of the claims with reference to the description and drawing, and do not limit the scope of protection represented by the claims.

I claim:

1. An industrial circular knitting machine for producing pattern work and plain jersey, the machine comprising:

a plurality of yarn feeders; a plurality of needles cooperating with oscillating selectors, wherein movement of individual selectors moves individual needles; sets of selection levers, said selection levers engaging said oscillating selectors to lift corresponding needles to a higher loop-clearing height and to a lower loop-retaining height; lifting cams for engagement with said oscillating selectors; lowering cams and corresponding counter cams for engagement with said oscillating selectors; symmetrically arranged pushing realignment cams, said realignment cams acting on butts of said oscillating selectors to position said butts in a row of butts of oscillating selectors for selection, partially-lowering cams for positioning said oscillating selectors for said selection; and realignment cams for the partial lifting of non oscillating selectors corresponding to unlifted needles for realignment of oscillating selectors corresponding to unlifted needles with oscillating selectors corresponding to needles previously lifted.

2. A machine according to claim 1, wherein all cams are positioned symmetrically about said feeders.

3. A machine according to claim 1, wherein all cams are positioned symmetrically about a mid-point between adjacent feeders.

4. A machine according to claim 1, wherein said selection levers act in an interval between zones of a maximum lowering and between said realignment cams, in both directions of motion.

5. A machine according to claim 1, wherein said lowering cams and corresponding counter cams define two adjacent zones of maximum lowering, pushing cams being positioned between said two adjacent zones to exclude selection of needles from action of a second zone of maximum lowering.

6. A machine according to claim 1, wherein pressers are provided to exclude needles which are active at certain feeders from lowering action, at least one of the feeders not being provided with a presser such that a stitch is formed with all yarns accumulated by a needle arriving at said at least one of the feeders.

7. A machine according to claim 1, wherein said selection levers act in a space between two zones of maximum lowering of the needles, a pusher is provided interacting with said oscillating selectors and an oscillating jack is provided interacting with said oscillating selectors, said oscillating jack being articulated to said needle, the oscillating selectors, pusher and needle with oscillating jack being contained in a single trick, said pusher acting to push said oscillating jack out and acting to re-lower said oscillating selectors.

8. An industrial circular Knitting machine for producing pattern work and plain jersey, a machine comprising:

a plurality of yarn feeders; a plurality of needles, each needle being connected to an oscillating jack; a plurality of oscillating selectors corresponding to said needles; a plurality of selection levers for acting on said oscillating selectors which in turn act on corresponding needle jacks for lifting corresponding needles to either a higher loop-clearing height or a lower loop-retaining height; lifting cams for lifting said oscillating selectors; lowering cams and corresponding counter cams for acting on said oscillating selectors; symmetrically arranged pushing realignment cams acting on said oscillating selectors to position butts of said oscillating selectors in a row of butts of oscillating selectors for selection by said selection levers; partial-lowering cams to predispose said oscillating selectors for selection; and realignment cams for a partial re-lifting of oscillating selectors corresponding to unlifted needles for realignment of oscillating selectors corresponding to unlifted needles with oscillating selectors corresponding to needles previously lifted.

* * * * *